US005862854A

United States Patent [19]

Gary

[11] Patent Number: 5,862,854

[45] Date of Patent: Jan. 26, 1999

[54] RADIANT HEATING PANEL

[75] Inventor: Harry J. Gary, Elkhorn, Wis.

[73] Assignee: RHP Systems, Inc.

[21] Appl. No.: 379,714

[22] Filed: Jan. 27, 1995

[51] Int. Cl.[6] ..... F24H 9/06

[52] U.S. Cl. ..... 165/55; 165/56; 165/171

[58] Field of Search ..... 165/53, 56, 171, 165/55, 178

[56] References Cited

U.S. PATENT DOCUMENTS

| | | | |
|---|---|---|---|
| 2,919,117 | 12/1959 | Hoffman | 165/56 |
| 3,314,475 | 4/1967 | Valyi . | |
| 4,064,866 | 12/1977 | Knight, Jr. . | |
| 4,080,703 | 3/1978 | Beck, Jr. | 165/171 X |
| 4,097,720 | 6/1978 | Sand . | |
| 4,098,261 | 7/1978 | Watt | 165/171 X |
| 4,269,172 | 5/1981 | Parker et al. | 165/56 X |
| 4,401,156 | 8/1983 | Wojtecki et al. . | |
| 4,635,710 | 1/1987 | Shelley | 165/56 X |
| 5,181,562 | 1/1993 | Kuriki . | |
| 5,195,289 | 3/1993 | La Londe et al. . | |
| 5,454,428 | 10/1995 | Pickard et al. | 165/178 X |
| 5,459,810 | 10/1995 | Villa | 165/55 |
| 5,597,033 | 1/1997 | Cali | 165/55 |

FOREIGN PATENT DOCUMENTS

| | | | |
|---|---|---|---|
| 1359891 | 3/1994 | France | 165/171 |

OTHER PUBLICATIONS

"Heat–Line 2000", Knud Holscher Industriel Design Denmark, date unknown.

"Radiantpanel hot water baseboard heating", Radiant Technology, Inc., date unknown.

*Primary Examiner*—Leonard R. Leo
*Attorney, Agent, or Firm*—Donald E. Egan

[57] ABSTRACT

A radiant heating panel designed for use in a hot water heating system includes an elongated aluminum extrusion having a non-metallic pipe positioned therein. Preferably, a CPVC plastic pipe is positioned in the elongated aluminum as part of a CPVC pipe heating system. A mounting bracket is also disclosed.

6 Claims, 1 Drawing Sheet

FIG. 1
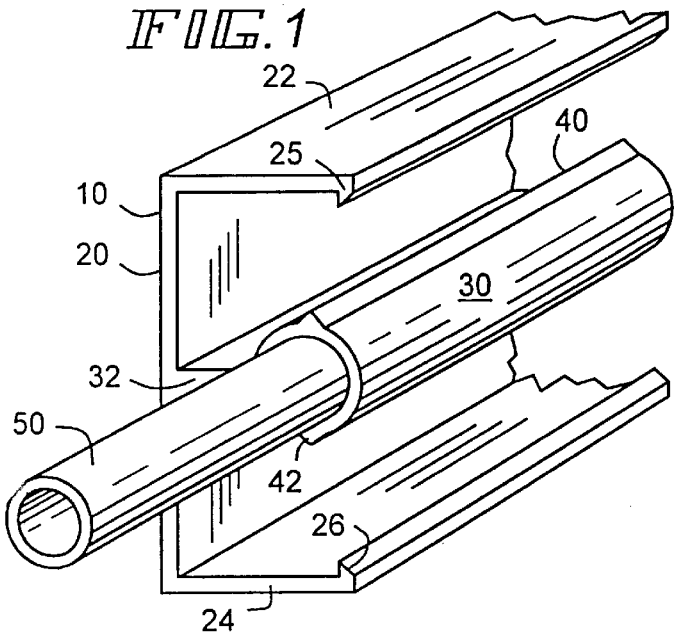
FIG. 2
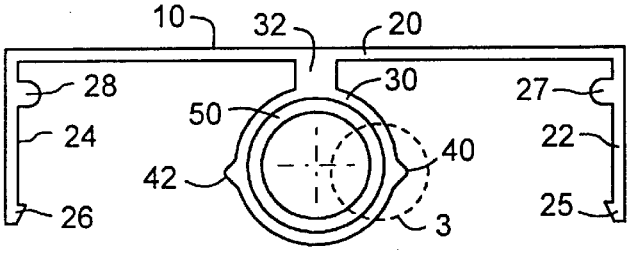
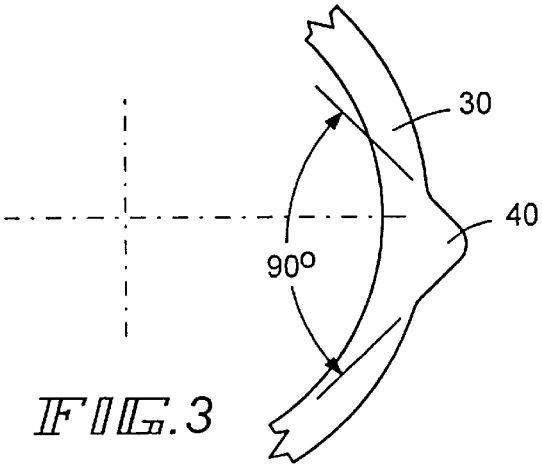
FIG. 3
FIG. 4
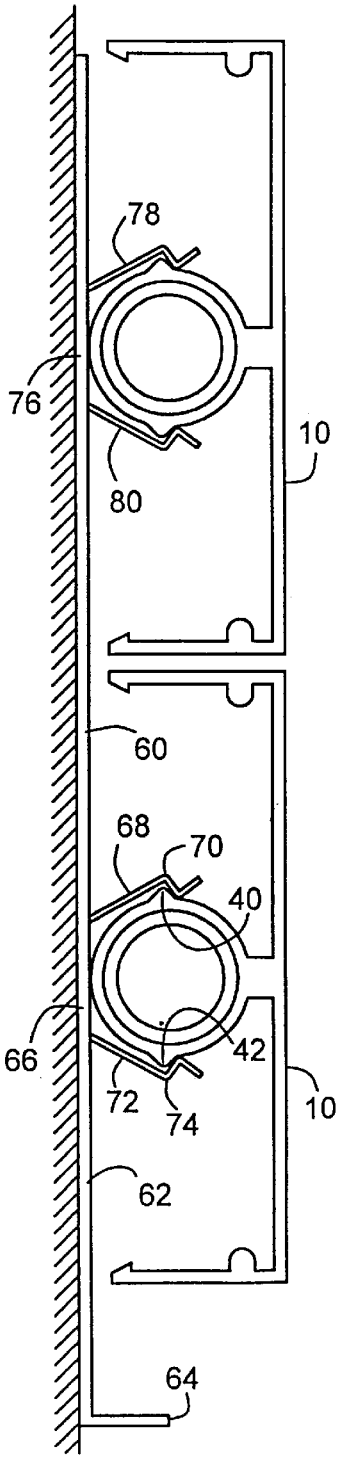

RADIANT HEATING PANEL

This invention relates to a radiant heating panel which is adapted to transfer heat from a heated fluid circulated through conduits associated with said panel to a space sought to be heated and to heating systems which use such panels. In particular, the radiant heating panel of the present invention comprises an aluminum extrusion which forms the heat radiating surface and a non-metallic pipe, positioned within said extrusion, which carries a heated fluid to the radiant heating panel.

BACKGROUND OF THE INVENTION

Heating systems based on "hot water" provide comfortable efficient heating of residential and other buildings. Hot water systems are particularly popular in certain areas of the country. Hot water systems which employ radiant heating panels are well known, but there have been problems associated therewith.

Generally speaking, hot water radiant heating panel systems use water which is heated in a boiler or water heater. In most cases the source of the heated water is located some distance from the radiant heating panels. In conventional copper or galvanized pipe systems, the water leaving the boiler in the copper tubing or galvanized pipe typically has a temperature of about 180° F. which approximates the temperature to which the water is heated in the boiler. The 180° water looses heat as it is pumped through the copper or galvanized pipes by radiation, conduction and convention from the time it leaves the boiler until it reaches the radiant heating panels. The further the boiler is located from the radiant heating panels, the greater the heat loss will be. Moreover, copper or galvanized pipes containing 180° water are hot enough to cause severe burning if they are inadvertently touched.

The prior art systems which employ copper conduit to carry the heated water to radiant heating panels made from aluminum or other metals, provide effective heat transfer between the heated water and the aluminum panel through the copper pipe and therefore have been deemed to be the most efficient materials of choice by the prior art. However, as explained above, such copper conduit systems have both heat loss and safety problems.

SUMMARY OF THE PRESENT INVENTION

The present invention contemplates the use of non-metallic pipe to deliver heated fluids to extruded aluminum radiant heating panels. It has been discovered, unexpectedly, that non-metallic pipe, such as CPVC pipe, can transfer heat to extruded aluminum radiant heating panels quite efficiently. Moreover, the non-metallic pipe does not loose as much heat as copper pipe in the space between the boiler and the radiant heating panel. Further, it has been found that non-metallic pipes, carrying water hot enough to drive the radiant heating panels, do not transfer heat to the surfaces at a rate which would cause burns to human skin. Accordingly, the radiant heating panels of the present invention is not only safer than prior art copper systems, but has an unexpectedly high efficiency.

BRIEF DESCRIPTION OF THE DRAWINGS

The objectives of the present invention will become apparent from the following description taken in connection with the accompanying drawings, wherein:

FIG. 1 is a isometric view of the radiant heating panel of the present invention;

FIG. 2 is a cross-sectional end view of the aluminum extrusion utilized in the radiant heating panel of the present invention;

FIG. 3 is an enlarged view of a portion of the panel of FIG. 2 showing the details of the projections on the exterior surface of the tube of the radiant heating panel; and FIG. 4 is an end view taken in section showing two radiant heating panels of the present invention engaged in a mounting bracket attached to a wall, which forms the preferred mode of the present invention.

DESCRIPTION OF THE PREFERRED EMBODIMENTS

Referring to the FIG. 1, the radiant heating panel of the present invention comprises elongated aluminum extrusion 10. Elongated extrusion 10 includes elongated face plate 20, side plates 22 and 24 and an integral, elongated tube 30 which is positioned parallel to face plate 20. Elongated tube 30 is integrally connected to face plate 20 through neck 32.

Preferably, tube 30 is centered between side plates 22 and 24 as shown in FIG. 1. In the preferred embodiment side plates 22 and 24 are provided with lips 25 and 26 which are used to engage decorative plastic panels to cover corners of the panels, to conceal plumbing connections to the radiant heating panel and fill the spaces between radiant heating panels. Alternatively, lips 25 and 26 may be used to engage various mounting systems.

As shown in FIG. 2, side plates 22 and 24 may be provided with ribs 27 and 28 which may be used to couple with various mounting plates.

In the preferred embodiment, elongated tube 30 is provided with a pair of lateral projections 40 and 42 which extend longitudinally along the outer surface of tube 30 in a plane parallel to face plate 20, as is more fully described below. As is shown in FIG. 4, projections 40 and 42 are adapted to cooperate with clips 66 and 76 of mounting bracket 60 to releasably affix radiant heating panel 10 in the desired installed position. Although the projections are not essential, the extrusion with projections provides a more secure engagement when used with mounting brackets having complementary notches in the arms of the clip.

As is shown in FIG. 2, projections 40 and 42 extend in a plane parallel to face plate 20. The sides of projections 40 and 42 are preferably set at a 45° angle to a plane parallel to face plate 20 and thus form a 90° angle at the apex. Projections 40 and 42 may be positioned on the outer surface of tube 30 less than 180° apart as shown in FIG. 3.

The CPVC pipe 50 is positioned within elongated tube 30. The size of pipe 50 is not critical from a functional point of view, but it is preferred to use a CVCP pipe which has an inner diameter and/or an outer diameter which will allow it to be coupled to standard size PVC fittings for ease of installation. The external diameter of pipe 50 should approximate the internal diameter of tube 30 so that the outer surface of pipe 50 contacts inner surface of tube 30 as much as possible. It is preferred that air or other gases be excluded from the interface between the inner surface of tube 30 and the outer surface of pipe 50. To that end, liquid adhesives may be used between pipe 50 and tube 30 in order to promote contact between those two surfaces and to eliminate any air or other gases that may exist between the two surfaces.

Referring now to FIG. 4, mounting bracket 60 is used to releasably affix two radiant heating panels 10 to a wall. Mounting bracket 60, which may be fabricated from steel, includes a back 62 from which clips 66 and 76 extend. Lower clip 66 has an upper arm 68 and a lower arm 72 which are adapted to engage the external surface of elongated tube 30 of aluminum extrusion 10. Preferably, the arms of clips 66 and 76 are provided with an upper notch 70 and a lower notch 74, respectively, adapted to engage the projections 40 and 42 of tube 30 of aluminum extrusion 10. Preferably, the notches 70 and 74 have a complementary shape to projections 40 and 42.

Bracket 60 is also provided with a foot 64 which may be used to rest the bracket on the floor of the building in which the system is being installed. Thus, foot 64 provides a uniform spacing for the radiant heating panels from the floor throughout the room in which the system is being installed.

FIG. 4 illustrates a mounting bracket designed to engage two radiant heating panels. Those skilled in the art will understand that the mounting bracket may be modified to engage one or more than two radiant heating panels. Moreover, the mounting bracket of the present invention may be used to install radiant heating panels using copper or other metallic pipes as well as the preferred CPVC pipes.

The elongated aluminum extrusion 10 is preferably fabricated from aluminum or an aluminum alloy. The particular aluminum alloy is not critical but an aluminum alloy designated 6063T5 is preferred. The aluminum extrusion illustrated by the drawings represents the preferred shape, but many variations may be employed. For example, the lips may be eliminated, the side plates shortened or eliminated and the extrusion may be provided with more than one tube.

The manufacturing technique used to make radiant heating panels of the present invention is not critical. However, it is preferred to fit the non-metallic pipe within the tube of the extrusion in a manner which will promote maximum surface contact between the outer surface of said pipe to the inner surface of said tube. The present invention contemplates, for example, heating the aluminum extrusion, to expand the tubing, and inserting a cool or chilled CPVC pipe in the heated extrusions. After assembly, a snug fit is achieved when the parts return to ambient temperature.

Alternatively, various liquid adhesives may be used to enhance the contact between the inner surface of the tube and the outer surface of the pipe, thus promoting effective heat transfer and eliminating the possible rotation of the pipe in the tube of the extrusion.

It is contemplated that the aluminum extrusions will be manufactured in standard lengths, such as 9 foot lengths, with the CPVC pipe mounted therein. Generally, it is preferred to have the CPVC pipe extend somewhat beyond the ends of the aluminum extrusion in order to facilitate coupling the radiant heating panel to the other pipes of the heating system.

The non-metallic pipe 50 is preferably fabricated from chlorinated polyvinyl chloride (CPVC). CPVC pipe may be used in hot water heating systems wherein the water temperature is between about 120° F. and 180° F. While other plastics may be used, the polyvinyl chlorides are generally preferred and chlorinated polyvinyl chloride is particularly preferred because of its ability to withstand heat and periodic heat cycling. A pipe sold under the name "un-copper" by Geneva, Inc. has particularly advantageous specifications.

The plastic pipes and in particular the CPVC pipes provide low loss of heat in the space between the source of heat, i.e. the boiler or water heating device, and the radiant panels. In many installations, the radiant heating panels are located a significant distance from the source of hot water. The low thermal loss provided by the plastic pipe is advantageous. Moreover, because the plastic pipe is generally a fairly poor conductor of heat, the surface of the plastic pipe will not transmit sufficient heat to a person should the person inadvertently touch the plastic pipe near the source of heat.

The use of plastic pipe is a great advantage over the conventional use of copper or galvanized pipe. For example, the CPVC pipe does not have to be installed using heat, i.e. it is not sweated as is the case with copper. The CPVC pipe does not need to be threaded which is the case with galvanized. Thus, the radiant heating panels of the present invention can be installed rapidly with the use of conventional CPVC fittings and conventional adhesives to seal the CPVC joints. The present invention allows the installer to cut the radiant heating panels equipped with CPVC pipe on the job to any desired length using simple hand tools, such as a hack saw. The newly cut end of the panel may be connected to the system by gluing a fitting to the interior surface of the CPVC pipe within the radiant heating panel. This installation procedure cannot be used in systems based on copper or galvanized pipe.

Further, the CPVC pipe is more flexible and less costly than copper pipe of the same dimensions. CPVC pipe resists splitting under freezing conditions which will cause copper pipe to split.

COMPARATIVE TEST

Two heating systems of comparable size were set up to compare the radiant heating panels of the present invention with prior art panels. Both systems included about 180 feet of baseboard radiant heating panels, a total of about 400 feet of pipe and held about 12.25 gallons of water (including the water in the boiler). Both systems were heated by 100,000 BTU gas fired boiler from Weil -McLain II, with a pump that circulated the water through the system at about 3 to 4 gallons per minute. The boiler was set to fire when the return water temperature reached 160° F., and turn off when the feed water reached 180° F. The "prior art" system was basically formed from copper tubing, including extruded aluminum panels with copper pipe therein. The "CPVC" system was basically formed from CPVC tubing including extruded aluminum panels with CPVC pipe therein.

| Operation Temperatures | prior art | CPVC |
|---|---|---|
| Boiler on - pump running: | | |
| Water at boiler feed | 180° F. | 180° F. |
| Panel surface at start | 160° F. | 150° F. |
| Water boiler return | 161° F. | 170° F. |
| Boiler off - after about 8 minutes - pump running: | | |
| Water at boiler feed | 180° F. | 180° F. |
| Panel surface | 150° F. | 150° F. |
| Water boiler return | 160° F. | 170° F. |

The heat output of the radiant heating panels fitted with copper pipe was about 125 BTU per foot, while which the heat output for the panels with the CPVC pipe was about 110 BTU per foot. However, the boiler in the copper system cycled (fired up) about every 10 minutes, while the boiler in the CPVC system cycled about every 18 minutes, under comparable conditions.

In operation, the radiant heating panels of the present invention may be used to radiate heat from a variety of heated fluid sources. While heated water is most commonly used, heated antifreeze or other liquids may be used. Under some circumstances, heated gases may be used as well, but the results using gases are not as efficient as using liquids.

The scope of the invention herein shown described is considered to be only as illustrative. It will be apparent to those skilled in the art that numerous modifications may be made therein without the departure from the spirit of the invention or the scope of the appended claims.

I claim:

1. A radiant heating panel comprising an elongated aluminum extrusion and a non-metallic pipe, said extrusion comprising an elongated face plate and an integral tube positioned parallel to said elongated face plate;

said face plate adapted to radiate sensible heat from said extrusion to a space sought to be heated;

said non-metallic pipe defining an external diameter and an external surface, said non-metallic pipe adapted to carry a heated fluid from an external heat source to said panel;

said integral tube including a pair of elongated projections extending longitudinally along the external surface of said integral tube, said projections releasably engaging complementary clips of a mounting bracket to releasably affix said panel at the desired location;

said integral tube having a cylindrical opening defining an internal diameter and an internal surface, said integral tube adapted to receive said non-metallic pipe;

said non-metallic pipe positioned within said integral tube, said external diameter of said non-metallic pipe closely matching said internal diameter of said integral tube and said outer surface of said non-metallic pipe contacts said inner surface of said integral tube whereby air gaps between said non-metallic pipe and said integral tube are minimized, and the heat transfer from said non-metallic pipe to said integral tube is maximized.

2. A radiant heating panel as described in claim 1, wherein said elongated projections lie in a plane parallel to said face plate.

3. The radiant heating system as described in claim 1, wherein said non-metallic pipe is fabricated from a plastic.

4. A radiant heating system as described in claim 3, wherein said non-metallic pipe is fabricated from a polyvinyl chloride.

5. The radiant heating system as described in claim 3, wherein said non-metallic pipe is fabricated from a chlorinated polyvinyl chloride.

6. The radiant heating system as described in claim 1, wherein an adhesive is included between said non-metallic pipe and said tube.

* * * * *